US006565679B1

(12) United States Patent
Jeffrey et al.

(10) Patent No.: US 6,565,679 B1
(45) Date of Patent: May 20, 2003

(54) EXTRUDABLE ALUMINUM ALLOYS

(75) Inventors: Paul W. Jeffrey, Kingston (CA); Christopher W. Jowett, Kingston (CA); Thiagarajan Ramanan, Cleveland, OH (US); Nicholas C. Parson, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/272,702

(22) Filed: Mar. 19, 1999

Related U.S. Application Data

(60) Provisional application No. 60/078,898, filed on Mar. 20, 1998.

(51) Int. Cl.[7] ..... C22C 21/08
(52) U.S. Cl. ..... 148/417; 420/534
(58) Field of Search ..... 148/440, 417; 420/534, 546, 535

(56) References Cited

U.S. PATENT DOCUMENTS

| | | | | |
|---|---|---|---|---|
| 3,370,943 A | * | 2/1968 | Beatty et al. | 75/142 |
| 4,525,326 A | | 6/1985 | Schwellinger et al. | |
| 4,589,932 A | | 5/1986 | Park | |
| 4,637,842 A | | 1/1987 | Jeffrey et al. | |

FOREIGN PATENT DOCUMENTS

| | | |
|---|---|---|
| GB | 2139246 | * 11/1984 |
| JP | 56-123346 | * 9/1981 |
| JP | 59-143039 | * 8/1984 |
| JP | 59-222550 | * 12/1984 |
| JP | 05-279780 | * 10/1993 |

OTHER PUBLICATIONS

"ASM Handbook: vol 4 Heat Treating", ASM International, 1991, pp. 851–857.*
"Metals Handbook: Desk Edition", 2nd ed, 1998, pp. 426–430, 480–481.*

* cited by examiner

*Primary Examiner*—George Wyszomierski
*Assistant Examiner*—Janelle Combs Morillo
(74) *Attorney, Agent, or Firm*—Cooper & Dunham LLP

(57) ABSTRACT

A novel extrudable aluminum based alloy is described consisting essentially of 0.60–0.84% magnesium, 0.45–0.58% silicon, 0.15–0.40% copper, 0.04–0.35% chromium, or 0.20–0.80% manganese, less than 0.25% iron, where Si>=(Mg/1.73+(Mn+Cr+Fe)/3–0.04), and the balance essentially aluminum. In the alloy of the present invention, the magnesium content has been reduced to the minimum possible for mechanical properties. In this way, the magnesium silicide content of the alloy has been reduced, providing a very beneficial effect on extrudability.

5 Claims, 8 Drawing Sheets

EXTRUDABLE ALUMINUM ALLOYS

This application claims the priority right of U.S. Provisional Patent Application No. 60/078,898, filed Mar. 20, 1998.

BACKGROUND OF THE INVENTION

The invention relates to aluminum alloys which contain magnesium and silicon and articles extruded therefrom.

The aluminum-magnesium-silicon alloys as contemplated herein are alloys having a major content of aluminum and minor contents of magnesium and silicon, and are exemplified by known alloys identified by Aluminum Association designations in the 6000 series, e.g. alloys having aluminum association (AA) designations such as 6009, 6010, 6011, 6061 and 6063. One of the most widely used of these 6000 series alloys has been Alloy 6061.

These 6000 series alloys are heat treatable and are well known for their useful strength and toughness properties in both T4 and T6 tempers.

Typical 6000 series aluminum alloys are described in Park, U.S. Pat. No. 4,589,932, issued May 20, 1986. That patent describes alloys 6061 and 6063 in some detail and refers to alloy 6061 as being useful for sheet, plate and forging applications.

These alloys are further discussed in Jeffrey et al., U.S. Pat. No. 4,637,842, issued Jan. 20, 1987. In that case, a 6061 stock was used in producing aluminum sheet for the use in the manufacture of aluminum cans.

Another Al—Mg—Si alloy is described in Schwellinger et al., U.S. Pat. No. 4,525,326, issued Jun. 25, 1985. This alloy was designed for producing extrusions and contained as an essential component 0.05 to 0.20% vanadium.

With medium strength Al—Mg—Si alloys, maximum extrusion speed is controlled predominantly by the percentage of magnesium silicide in the alloy. This determines the hot flow stress of the alloy and therefore the temperature rise that occurs during deformation. The maximum extrusion speed is that at which the surface begins to tear or speed crack. This occurs when the surface temperature reaches the solidus temperature of the alloy. For any starting billet temperature, a reduction in the heat of deformation allows a higher speed.

The relation between temperature rise and speed follows a log (speed) relation. Therefore, small reductions in the magnesium silicide percentage and corresponding small changes in the flow stress and temperature rise can have a very significant effect on the maximum speed.

A typical AA6061 alloy in commercial use is 0.88% Mg, 0.60% Si, 0.20% Fe, 0.20% Cu, 0.08% Cr and less than 0.2% manganese and the balance essentially aluminum. Commercial operating conditions are generally non-optimum which results in incomplete solution treatment and in some instances precipitation of the magnesium silicide during quenching. It has been found that AA6061 is typically richer in magnesium and silicon than is actually required to achieve AA6061-T6 mechanical properties, which is the property target recognized for structural applications in the North American extrusion industry.

It is the object of the present invention to provide an alloy for structural applications having improved extrudability without risk of compromising mechanical properties.

SUMMARY OF THE INVENTION

The present invention in its broadest aspect relates to an extrudable aluminum based alloy consisting essentially of 0.60–0.84% by weight magnesium, 0.40–0.58% by weight silicon, 0.15–0.40% by weight copper, 0.06–0.20% by weight chromium, or 0.20–0.80% by weight manganese, less than 0.25% by weight iron, where Si>=(Mg/1.73+(Mn+Cr+Fe)/3−0.04), and the balance essentially aluminum.

A preferred alloy contains 0.64–0.84% magnesium and 0.45–0.58% silicon, more preferably 0.64–0.80% magnesium and 0.45–0.58% silicon.

In the alloy of the present invention, the magnesium content has been reduced to the minimum possible for mechanical properties. In this way, the magnesium silicide content of the alloy has been reduced, providing a very beneficial effect on extrudability. Thus, there are productivity gains based on reduction in flow stress and extrusion pressure.

It has been found that it is the melting point of the alloys of this invention that is the direct cause of these alloys being capable of meeting AA6061-T6 mechanical properties with significantally improved extrudability

DESCRIPTION OF THE PREFERRED EMBODIMENTS

Extrudability tests have been carried out and these have shown that the alloy of the present invention with reduced magnesium silicide content requires a lower pressure than standard AA6061. This means that for a given available press pressure, a colder billet can be extruded. Moreover, the lower starting temperature allows a higher speed before the limiting surface temperature is reached. Excess magnesium over that required to form magnesium silicide is detrimental to extrudability and should be controlled in order for optimum press performance.

The copper in the composition is required for increasing the age hardening response of the alloy and a minimum of 0.15 wt % Cu is necessary to achieve the required strength levels. Manganese and chromium are not essential but are very desirable to give satisfactory toughness for structural applications and offer great flexibility in the use of the alloys.

The alloys of the invention are preferably homogenized at a soak temperature of about 550–585° C. and the extrusions are preferably quenched at a rate of at least 3° C. per second.

EXAMPLE 1

To demonstrate the practice of the invention and the advantages thereof, aluminum alloy were made having the following compositions:

TABLE 1

| Alloy | Mg | Si | Fe | Cu | Cr | Mn | Al |
|---|---|---|---|---|---|---|---|
| A | 0.84 | 0.60 | 0.19 | 0.20 | 0.07 | <0.02 | Balance |
| B | 0.88 | 0.59 | 0.18 | 0.20 | 0.08 | 0.03 | Balance |
| C | 0.87 | 0.63 | 0.20 | 0.21 | 0.07 | 0.06 | Balance |
| D | 0.74 | 0.53 | 0.18 | 0.20 | 0.07 | <0.02 | Balance |
| 6005 A | 0.48 | 0.68 | 0.19 | 0.09 | 0.01 | <0.02 | Balance |

Figure 1:
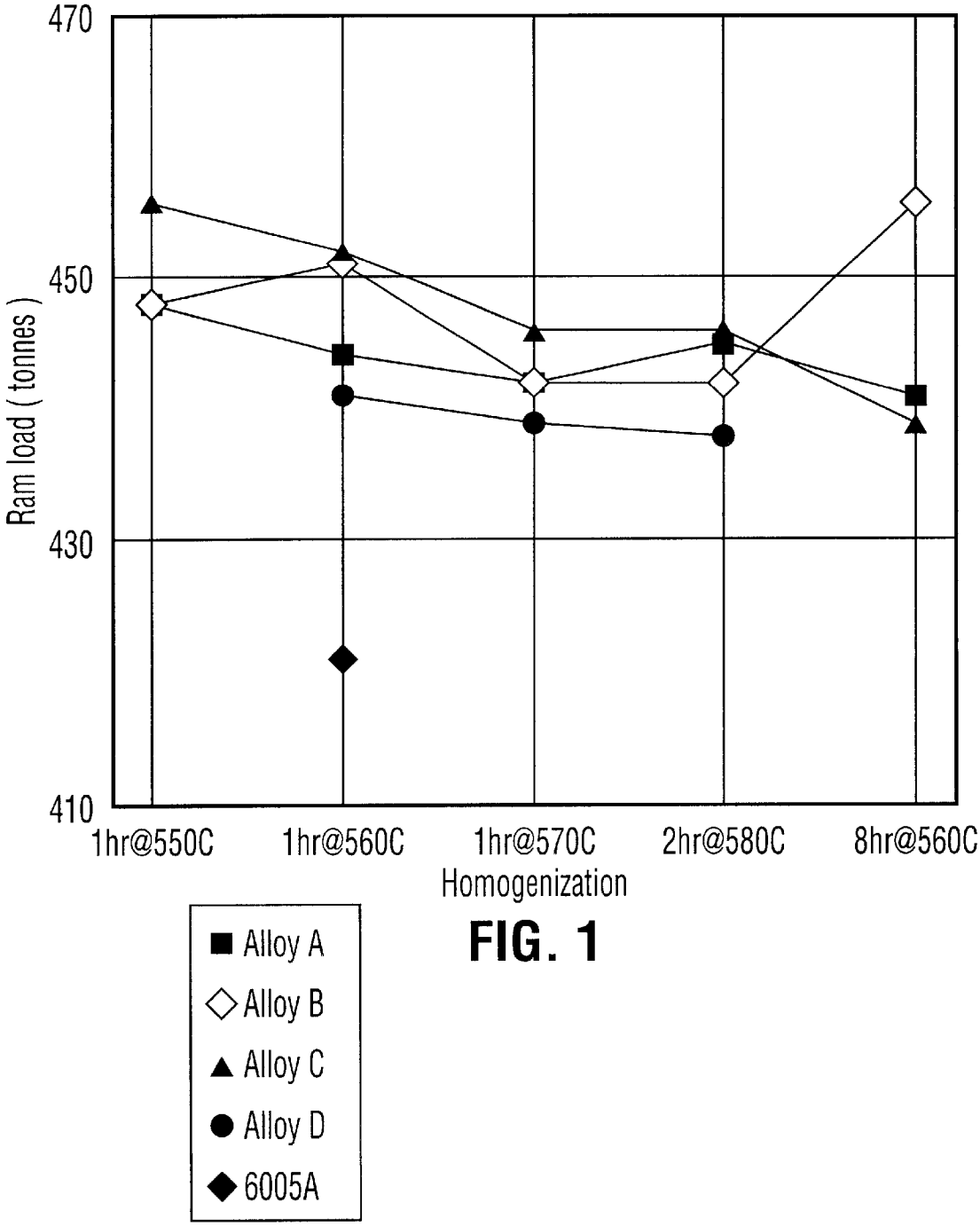
FIG. 1 is a graph plotting ram load versus homogenization conditions.

The above alloys were homogenized at different times and temperatures and the breakthrough load in tonnes was measured for the five alloy variants at five different homogenization conditions. The results are shown in FIG. 1.

Pressure reductions of the order of one to three percent were measured and this equates to a reduction of approximately 25° F. in the minimum billet temperature that can be extruded. Percentage increases in speed that can be expected from such a reduction vary from 15 to 30%.

Figure 2:
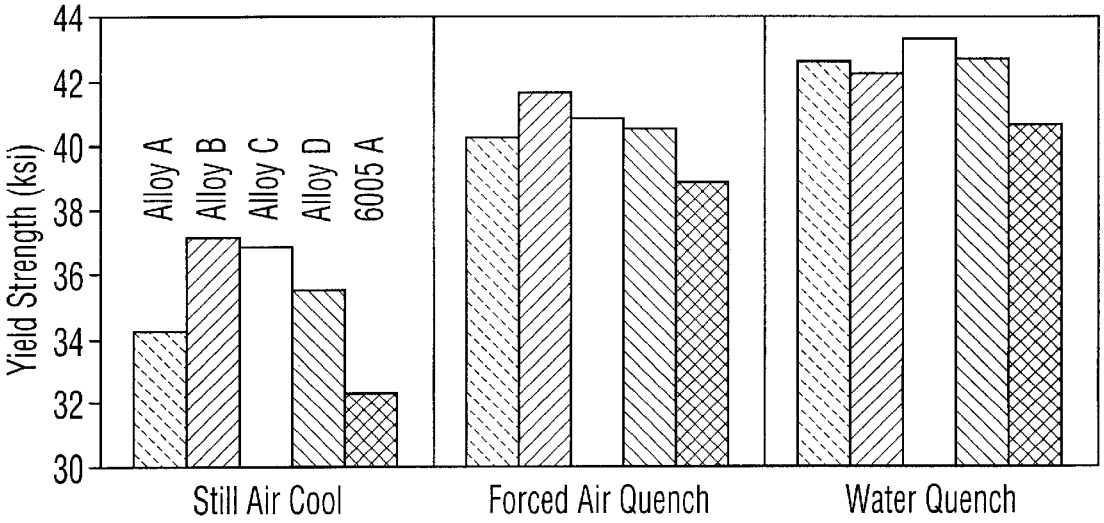
FIG. 2 is a graph showing tensile yield strengths of different alloy compositions and quenching conditions.
Figure 3:
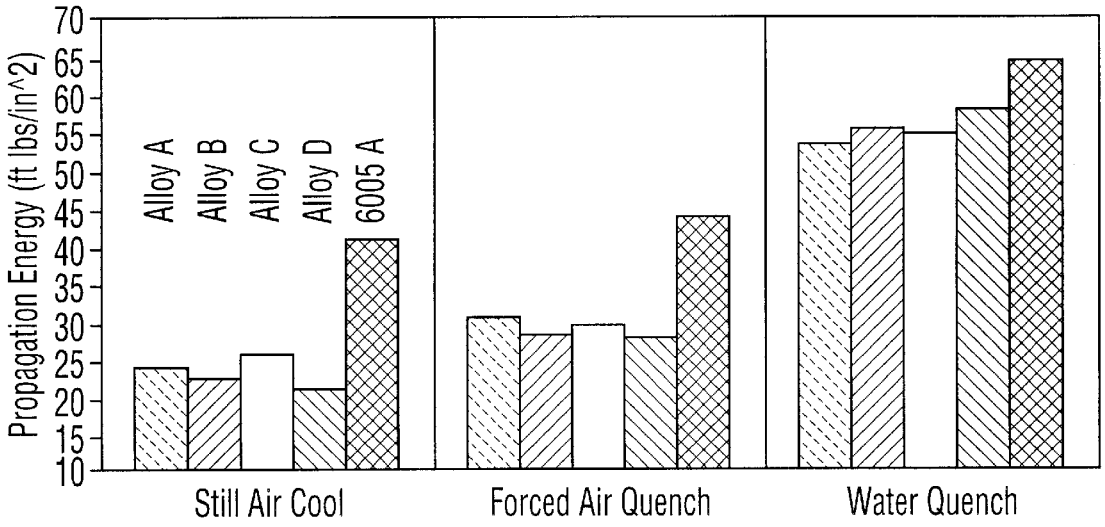
FIG. 3 is a graph showing Kahn crack propagation energies (a measure of notch toughness) for various alloys and quenching conditions.

The five different alloys were also tested for strength and toughness properties in T6 tempers. To achieve this, the alloys A, B, C and D were homogenized for two hours at 580° C., while the 6005A alloy was homogenized for one hour at 560° C. They were cooled under three different conditions, namely (a) still air cool, (b) forced air quench and (c) water quench. The results are shown in FIGS. 2 and 3.

It can be seen that the data for Alloy D (0.74% Mg) is equivalent to that of the regular 6061-Alloy A.

EXAMPLE 2

A series of aluminum alloys were prepared having the following compositions:

TABLE 2

| Alloy | Si | Fe | Cu | Mg | Cr | $Mg_2Si$ | xs.Si |
|---|---|---|---|---|---|---|---|
| MNE | 0.57 | 0.18 | 0.19 | 0.84 | 0.07 | 1.3188 | nil |
| MND | 0.52 | 0.18 | 0.19 | 0.77 | 0.07 | 1.2089 | nil |
| MNB | 0.45 | 0.15 | 0.19 | 0.64 | 0.07 | 1.0048 | nil |
| MNC | 0.5 | 0.17 | 0.19 | 0.69 | 0.07 | 1.0833 | 0.0212 |
| MNF | 0.53 | 0.16 | 0.19 | 0.64 | 0.08 | 1.0048 | 0.0801 |
| MNG | 0.56 | 0.18 | 0.19 | 0.7 | 0.08 | 1.099 | 0.0687 |

These were cast as 178 mm diameter billet. Alloy MNE is very similar to alloy A in Example 1. The billets were homogenised at 580° C. followed by cooling to room temperature at ~350° C./hr. They were then induction preheated to 480° C. and extruded into three shapes; a 10 mm dia bar, a 38×3 mm strip and a 38×3 mm strip. The extrusion speed for the 10 mm dia. was varied until the onset of tearing was found which was used as a measure of productivity. The extrusions were quenched at a number of different rates by using various air flow rates and a water quench system. The quenched extrusions were artificially aged for 7 hours at 175° C. Mechanical properties, including tensile properties and toughness, of selected extrusions were then measured.

Figure 4:
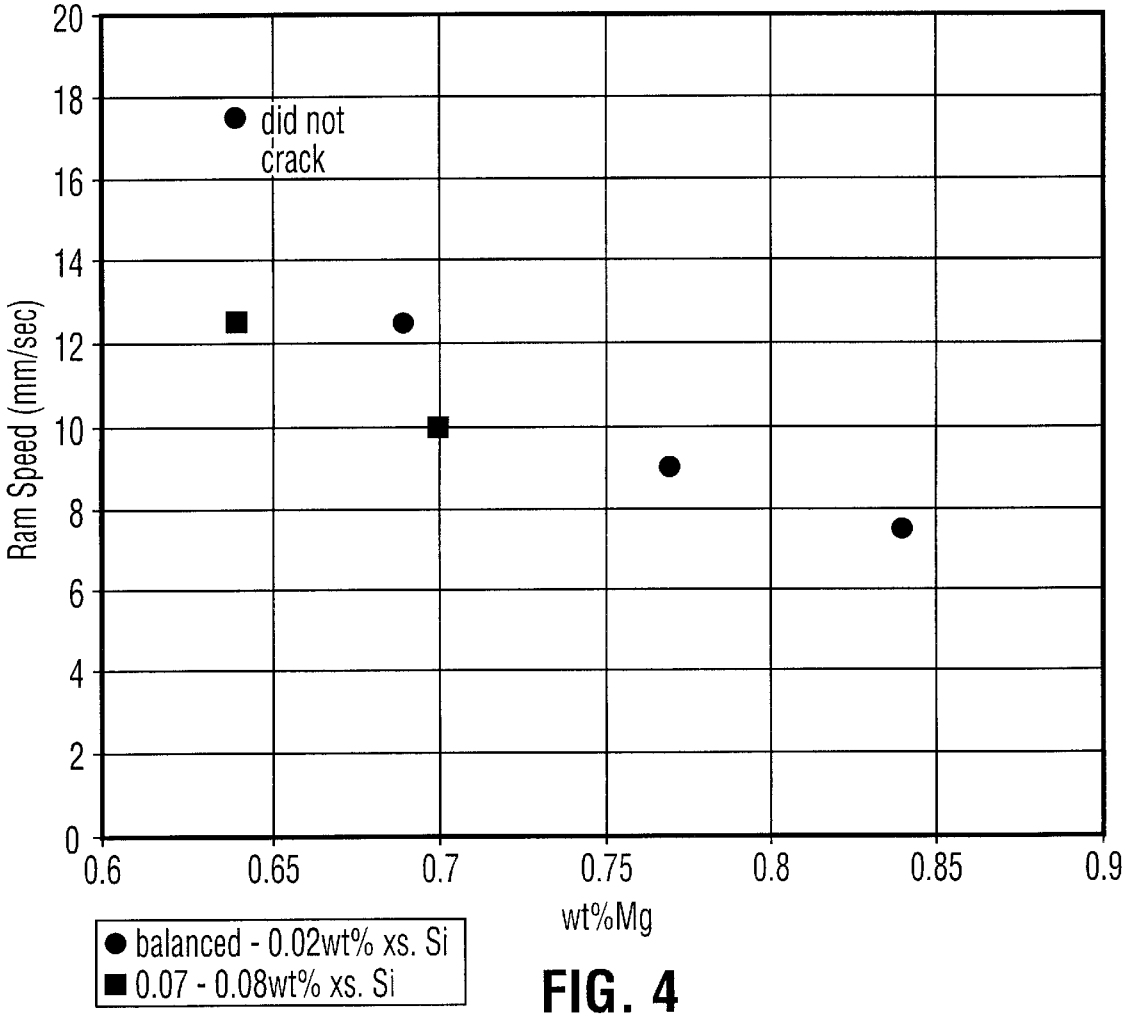
FIG. 4 is a graph showing effect of Mg and Si levels on cracking speed.

Most of the alloy compositions tested (as shown in Table 2) were close to being balanced in terms of $Mg_2Si$ with the exception of two variants, MNF and MNG, where the excess silicon (xs.Si) was increased to 0.07–0.08 wt %. FIG. 4 shows the cracking speed as a function of composition. The maximum extrusion speed possible before tearing occured increased progressively as the magnesium content was decreased. The alloys with an excess silicon addition exhibited tearing earlier than the balanced alloys.

Figure 5:
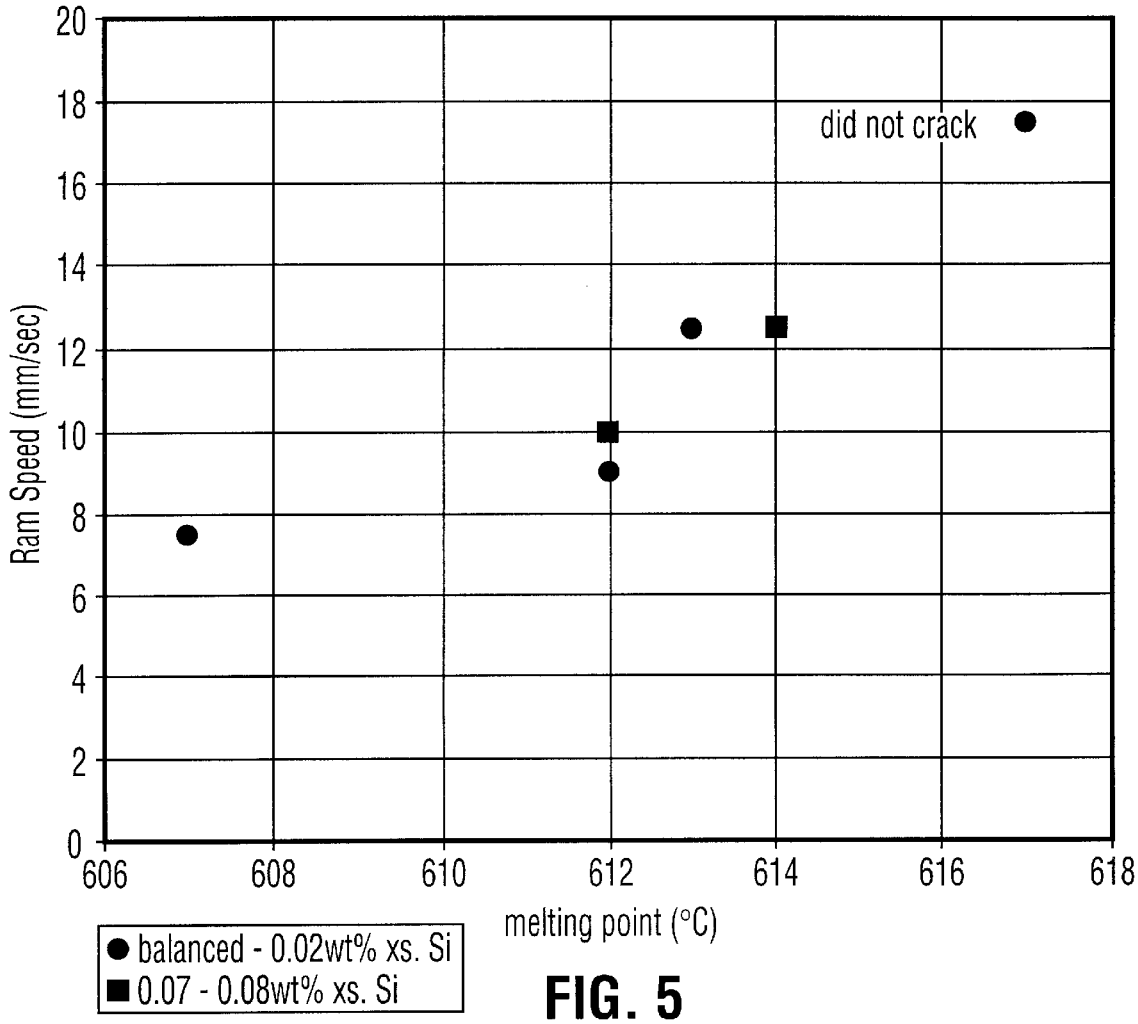
FIG. 5 is a graph showing relationship between cracking speed and melting point.
Figure 6:
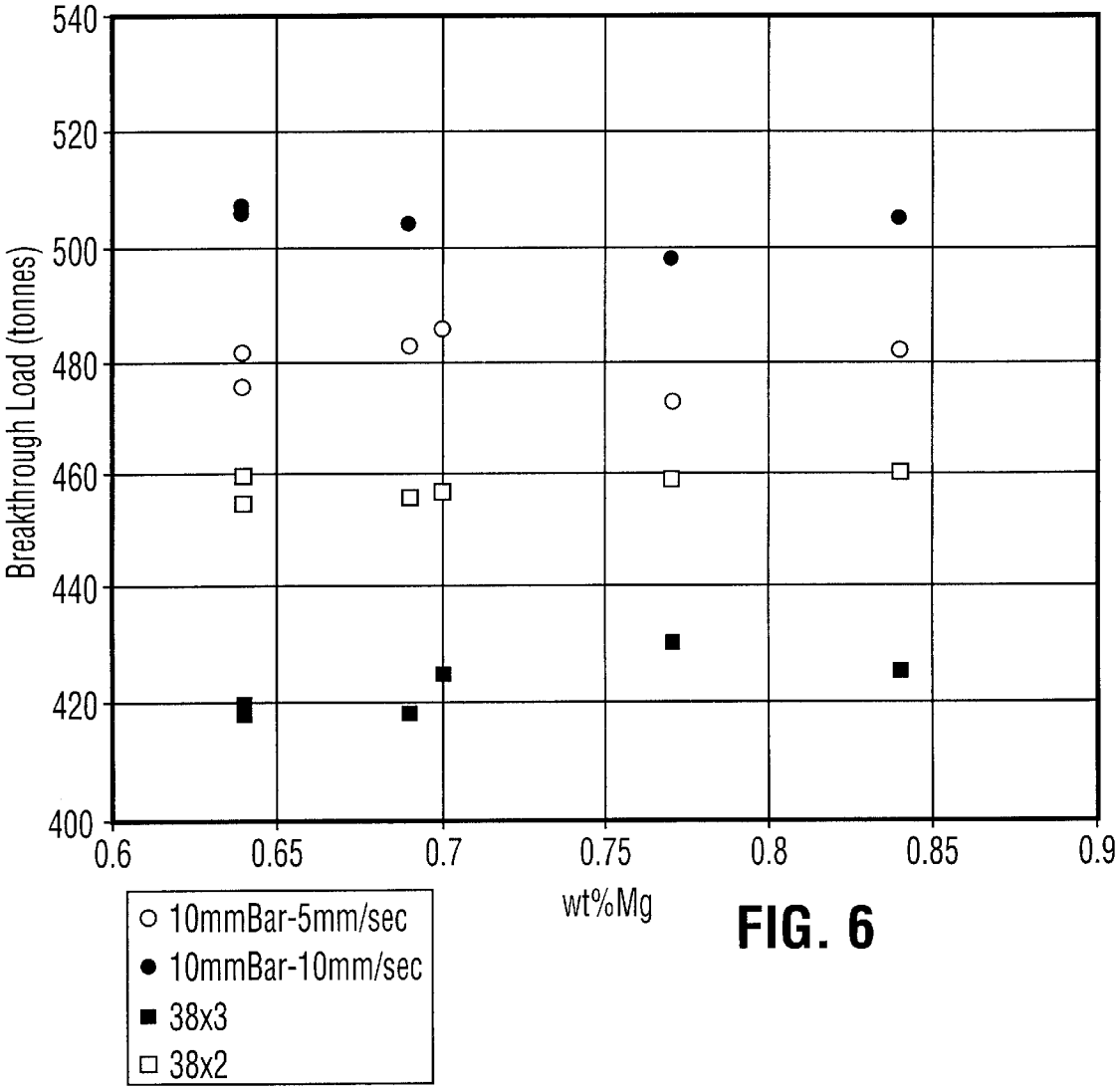
FIG. 6 is a graph showing extrusion load vs. composition.

FIG. 5 shows the effect of melting point on the tearing speed. For all compositions, regardless of excess silicon, the cracking speed increased as the melting point was raised. FIG. 6 shows the effect of composition on extrusion breakthrough load. There was no variation in extrusion load across the range of compositions studied. The increase in speed with decreasing magnesium content therefore appears to be due to the increase in the melting point.

Figure 7A:
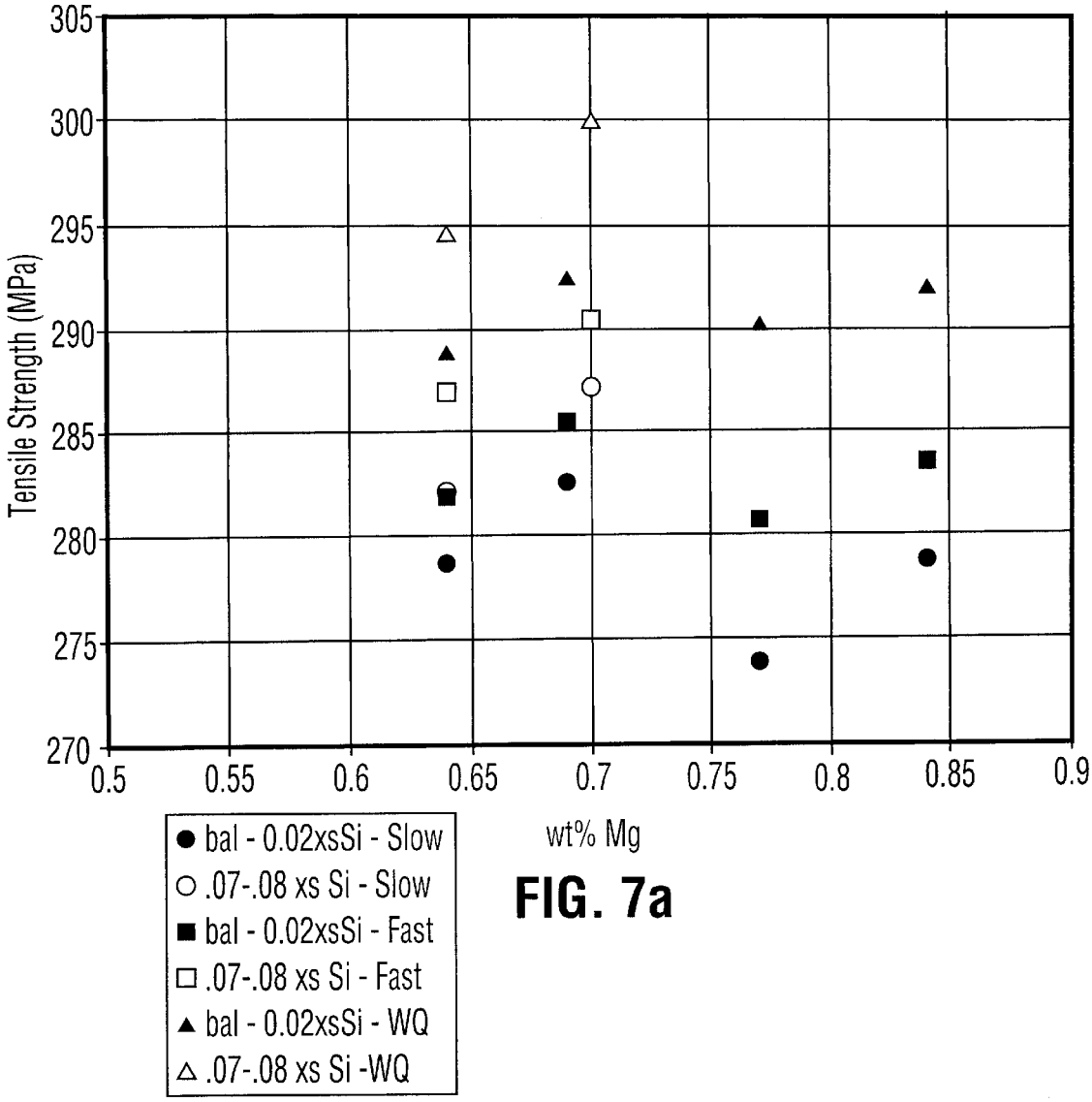
FIG. 7*a* is a graph showing the effect of composition on press quenched and aged UTS.
Figure 7B:
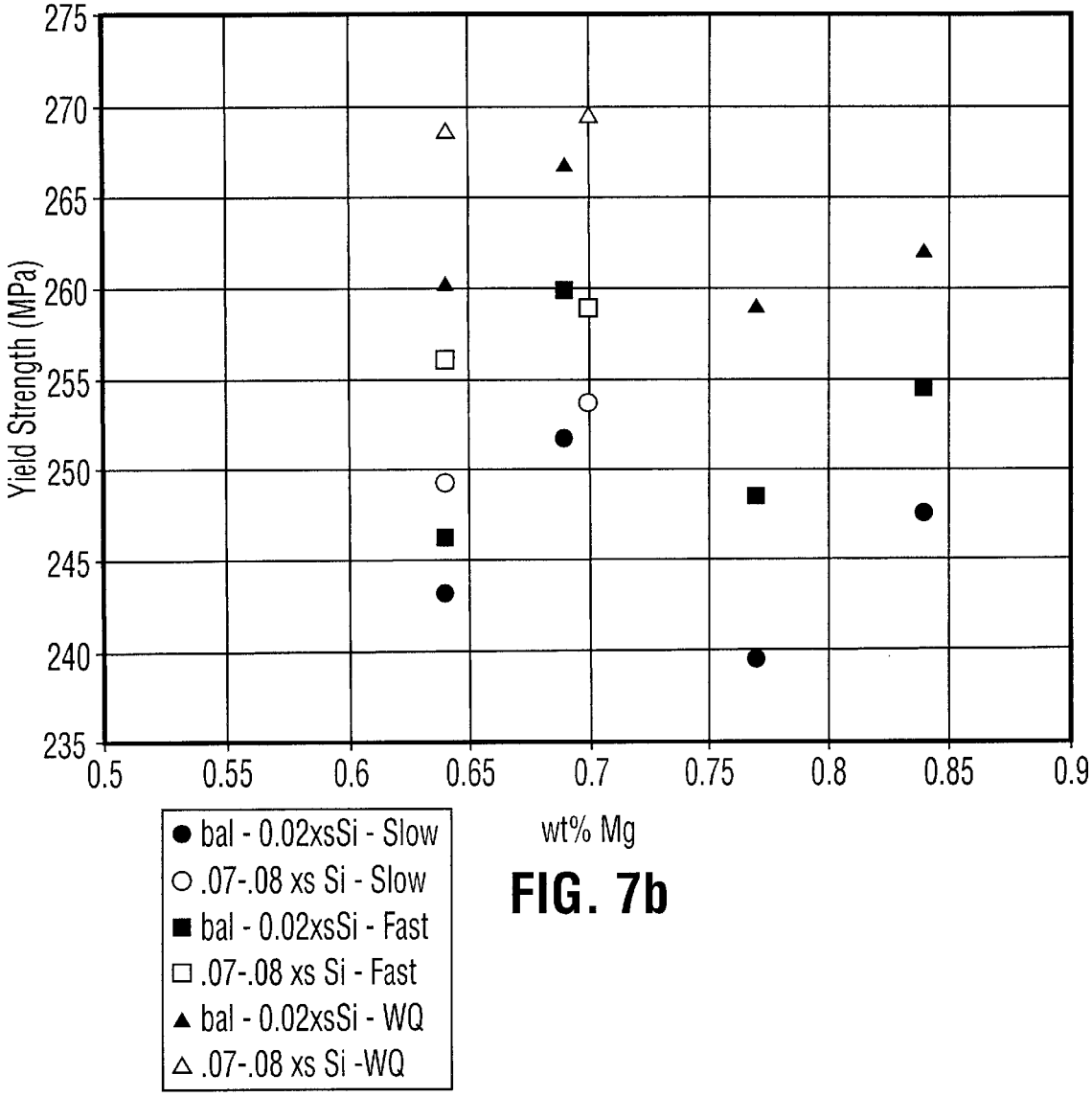
FIG. 7*b* is a graph showing the effect of composition on press quench and aged yield stress.
Figure 7C:
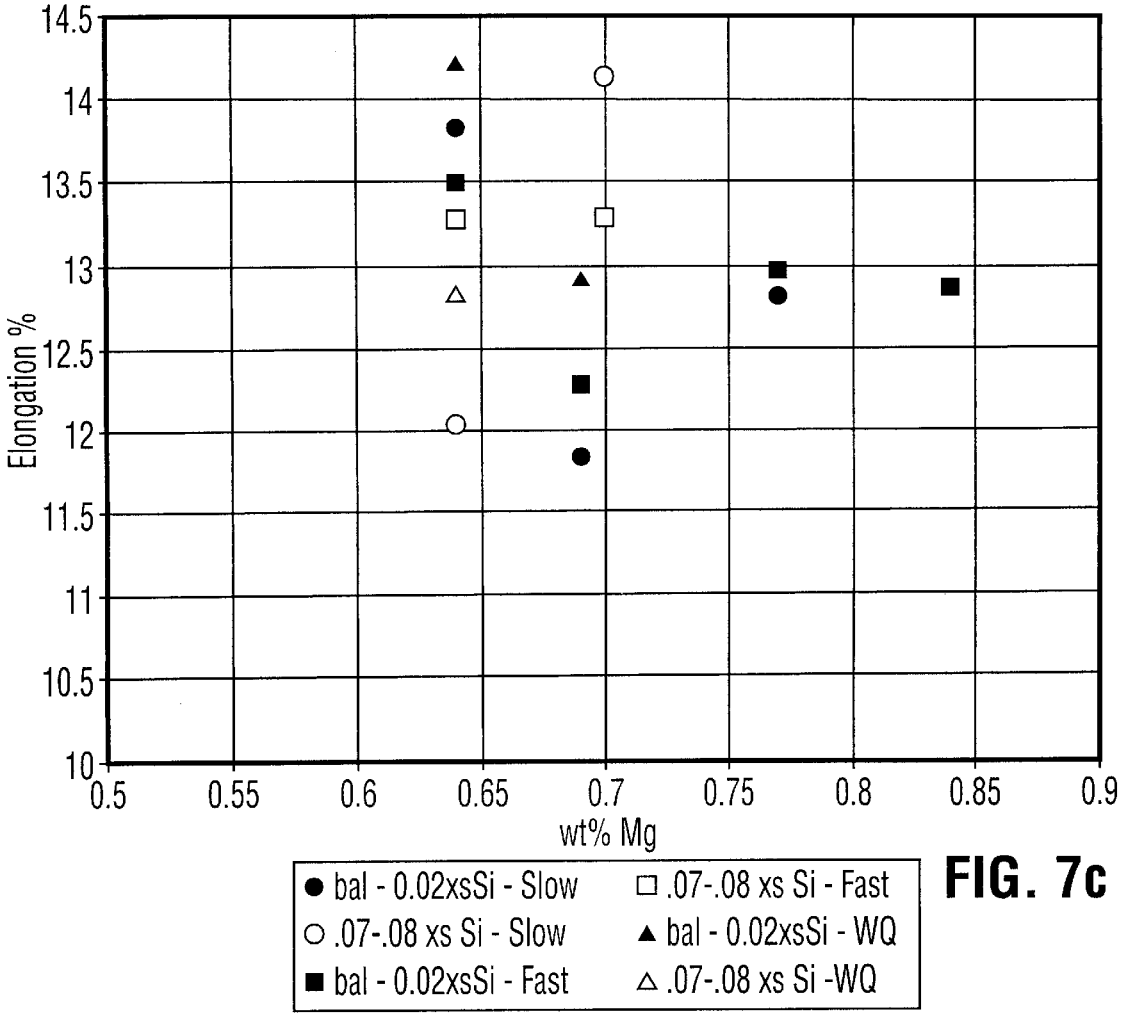
FIG. 7*c* is a graph showing the effect of composition on press quenched and aged elongation.

The aged extrusions were also subjected to tensile testing for three quench rates applied as a function of compositions. The results are shown in FIGS. 7*a*, 7*b* and 7*c*. The results show that the yield and tensile strengths increase with faster quench rates and higher excess silicon levels. However, the properties are independent of the magnesium content. It was found that with sufficiently high quench rate, all the compositions tested are capable of meeting the 6061-T6 tensile requirements (260 Mpa UTS, 240 Mpa Proof Stress, 8% Elongation).

Figure 8:
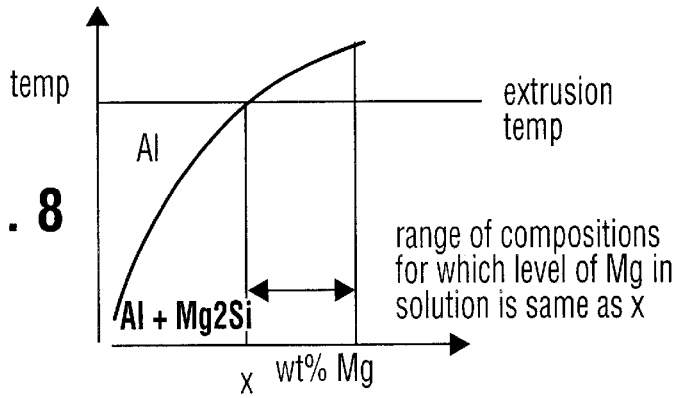
FIG. 8 is a graph schematically showing how magnesium level in solution is fixed by extrusion temperature.

Speed cracking is initiated when the extrusion surface temperature reaches the alloy melting point. Raising the melting point moves this condition to a higher exit speed. The insensitivity of the extrusion load to the magnesium content of the alloy is initially surprising. However, the extrusion load is controlled by the amount of magnesium in solid solution. In practice commercial extrusion temperatures are rarely high enough to dissolve all the magnesium silicide for alloys of this type. The level of magnesium in solid solution is therefore defined by the extrusion temperature and the alloy solvus curve and can be independent of alloy composition. This effect is illustrated schematically in FIG. 8.

What is claimed is:

1. Extrudable aluminum base alloy consisting essentially of 0.60–0.84% magnesium, 0.40–0.58% silicon, 0.15–0.40% copper, less than 0.25% iron, and 0.06–0.20% chromium, where Si>=(Mg/1.73+(Mn+Cr+Fe)/3−0.04), and the balance essentially aluminum.

2. An alloy according to claim 1 which contains 0.64–0.84% magnesium and 0.45–0.58% silicon.

3. An alloy according to claim 1 which contains 0.64–0.80% magnesium.

4. An aluminum base alloy extruded product consisting essentially of 0.60–0.84% magnesium, 0.40–0.58% silicon, 0.15–0.40% copper, less than 0.25% iron, and 0.06–0.20% chromium, where Si>=(Mg/1.73+(Mn+Cr+Fe)/3−0.04), and the balance essentially aluminum, produced by extruding a billet after homogenizing the billet at a temperature of about 550° to about 585° C.

5. Extrudable aluminum base alloy consisting essentially of 0.60–0.84% magnesium, 0.40–0.58% silicon, 0.15–0.40% copper, less than 0.25% iron, and 0.06–0.20% chromium, where Si≧(Mg/1.73+(Mn+Cr+Fe)/3−0.04), and the balance essentially aluminum, said alloy having the property of being capable of attaining a yield strength of at least about 35 ksi when extruded and cooled in still air.

* * * * *